United States Patent [19]

Gondek

[11] 4,013,230

[45] Mar. 22, 1977

[54] SHOWER HEAD

[76] Inventor: John T. Gondek, 1641 W. Innsbruck Circle, Minneapolis, Minn. 55421

[22] Filed: Nov. 10, 1975

[21] Appl. No.: 630,188

[52] U.S. Cl. ..... 239/499; 239/590.3; 239/600

[51] Int. Cl.[2] ..... B05B 1/26

[58] Field of Search ..... 285/23, 81, 39; 85/32 R; 239/499, 498, 587, 590.3, 600; 215/220

[56] References Cited

UNITED STATES PATENTS

| | | | |
|---|---|---|---|
| 2,044,445 | 6/1936 | Price et al. | 239/587 |
| 2,086,017 | 7/1937 | Donahue | 239/587 X |
| 2,990,123 | 6/1961 | Hyde | 239/499 X |
| 3,261,254 | 7/1966 | Pinkerton | 85/32 R |
| 3,321,141 | 5/1967 | Gemeny | 239/498 X |
| 3,650,426 | 3/1972 | Miller | 215/220 |

*Primary Examiner*—John J. Love
*Attorney, Agent, or Firm*—Douglas L. Carlsen

[57] ABSTRACT

A shower head having a main body with a passageway extending therethrough and adapted to be connected to the end of a water supply pipe, an annular skirt attached to the outlet end of the body and a multi-apertured disk mounted on the body for breaking up the water flowing through the passageway into a series of high velocity jet sprays, said apertures so positioned as to direct the jet sprays downwardly in a relatively diverging pattern into engagement with the lower edge of the annular skirt to diffuse the sprays as they leave the shower head.

8 Claims, 5 Drawing Figures

FIG. 1
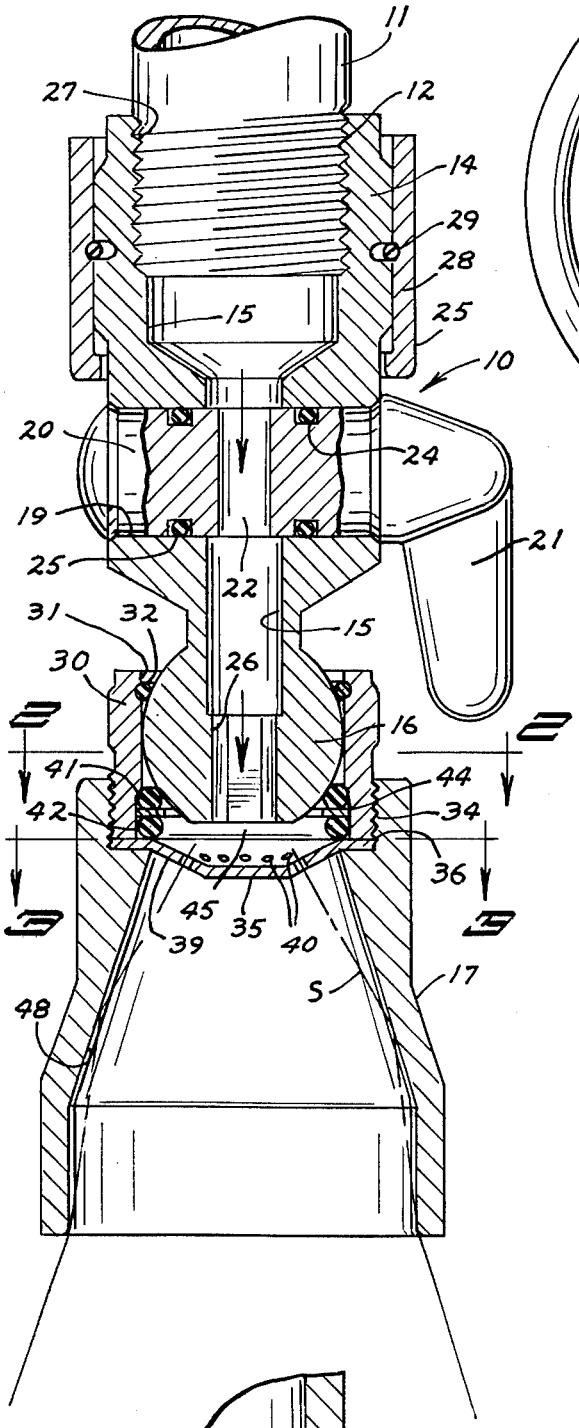
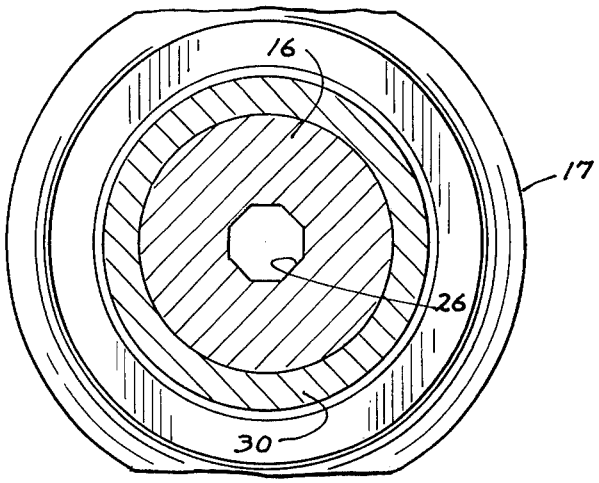
FIG. 2
FIG. 3
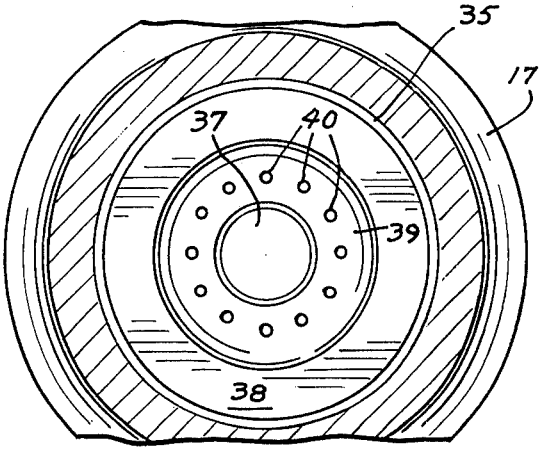
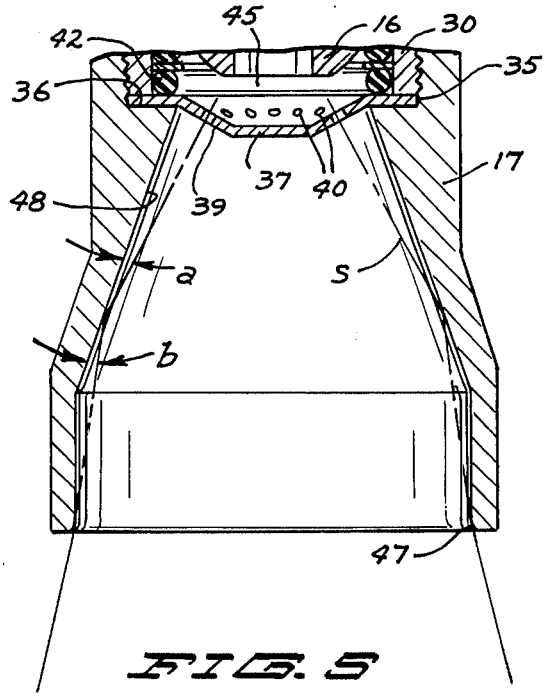
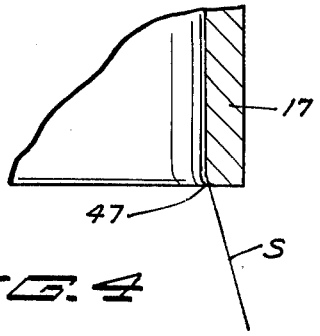
FIG. 4
FIG. 5

SHOWER HEAD

BACKGROUND OF THE INVENTION

This invention relates generally to the art of diffusing a stream of water into a series of fine sprays for human shower purposes and more particularly concerns the shower head for effecting such diffusion.

Conservation of water and heat producing fuel are both important in the ever-growing effort to save our natural resources. Human bathing can best be accomplished by use of a shower where the stream of water from the water supply is diffused by a shower head into a series of sprays which engage and run downwardly along the body. A considerable amount of water and fuel to heat the same can be conserved by converting the water stream into very fine high velocity jet sprays as they serve to wash and rinse the body with equal, if not greater, effectiveness than larger sprays.

One manner of providing the jet sprays is to provide a perforate disk or the like in the shower head having an open area which is somewhat less than the cross sectional area of the inlet line so as to build up the water pressure above the disk. This type of structure while common to most sprinklers is specifically disclosed in U.S. Pat. Nos. 2,256,729 to Thompson and 3,831,860 to Gullaksen.

While the jet spray conserves water it is also desirable in shower use if the spray can be diffused somewhat before contacting the body both for purposes of comfort and broader area coverage.

SUMMARY OF THE INVENTION

An object of the present invention is to provide a shower head which restricts the flow of water therethrough to conserve water and fuel for heating the same and yet which produces an improved diffused spray pattern for broad coverage of a person bathing under the shower head.

Another object of the invention is to provide a shower head which is extremely difficult to remove from the water supply line to render theft thereof virtually impossible.

Still another object of the invention is to provide a shower head having a tubular discharge casing or skirt which is mounted on a ball for universal swivel movement and with a new and improved seal between the ball casing to prevent water leakage.

With these and other objects in view the invention broadly comprises an elongated shower head body having one end threaded onto the water supply line and an annular discharge skirt mounted on the other end and a passageway extending therethrough. The lower end portion of the passageway is configured to provide a socket for a wrench to thread the body onto the line while the upper portion of the body has a freely rotatable sleeve mounted in encircling relation thereon. A perforate disk is mounted on the body above the sleeve to restrict the flow of water through the shower head passageway and the disk perforations are so positioned as to direct fine jet sprays of water against the lower edge of the skirt.

BRIEF DESCRIPTION OF THE DRAWINGS

In the drawings:

FIG. 1 is a longitudinal diametrical section through the shower head with the flow control valve open.

FIG. 2 is a section taken on line 2—2 of FIG. 1.

FIG. 3 is a section taken on line 3—3 of FIG. 1.

FIG. 4 is an enlarged fragmentary view of the lower edge of one wall of the shower head skirt showing the direction of flow of one spray jet.

FIG. 5 is a slightly enlarged view of the lower portion of FIG. 1 and also showing the direction of flow of the spray jets.

DESCRIPTION OF THE PREFERRED EMBODIMENT

Referring now more particularly to the drawing reference numerals will be used to denote like parts or structural features in the different views. The shower head denoted generally at 10 is connected to the end of shower pipe 11 which has a threaded portion 12 onto which the body 14 of the shower head is secured. Body 14 has an internal passageway 15 extending therethrough. The lower end of body 14 is formed as a ball 16 for swivel mounting of the water outlet skirt or sleeve 17 thereon.

The body 14 is provided with a cross passage 19 near its longitudinal center. Passage 19 journals a plug cock 20 which has a handle 21 at one end for rotation of the cock within passage 19. The cock 20 has a port 22 extending diametrically therethrough adapted to open the passageway 15. At each side of the port 22 the cock has circumferential grooves 24 which seat O-rings 25. It will be understood that the plug cock 20 serves as a valve for opening and closing the passage 15, the passage being open for flow of water therethrough when port 22 is aligned with the passage.

The lower end portion 26 of passage 15, which portion extends through ball 16, is hexagonal or some other non-circular design in cross section. The upper end portion of body 14 is internally threaded as at 27 for threading onto the threaded portion 12 of pipe 11. A sleeve 28 is mounted on the upper portion of the body 14, which may be of hexagonal stock, in encircling relation thereto as by a snap ring 29 which seats in aligned grooves in the sleeve and body. Sleeve 28 is held against axial displacement from the body 14 while permitting rotation of the sleeve. This may be accomplished by using a snap ring 29 or swaging the upper portion of the sleeve inwardly. The purpose of the sleeve 28 is to make the removal of body 14 from pipe 11, as by theft, more difficult. It will be understood that the sleeve 28 will rotate freely when gripped by a pliers or the like without unthreading the body 14 from the pipe.

The body 14 is threaded onto the pipe 11 by inserting a hexagonal wrench into the socket 26. This socket is, of course, well concealed after the body 14 is mounted and is virtually inaccessible for removal of the body.

The water outlet skirt 17 is mounted on the ball 16 of body 14 by a socket ring 30. This ring has an internal groove 31 near its upper edge which seats a snap ring 32 to hold the ring on ball 16 and permit it to swivel thereon. Ring 31 could also be mounted by swaging the upper edge thereof inwardly. The lower portion of ring 30 is externally threaded at 34 for threading of the upper portion of skirt 17 thereon. A disk 35 is secured between the lower end of ring 30 and a shoulder 36 formed in the interior wall of sleeve 17. Disk 35 has a dished configuration with a flat central portion 37 and a flat marginal flange 38 connected by a broad frustoconical disk portion 39 provided with a series of jet apertures 40.

A seal between ball 16 and the ring 30 comprises upper and lower O-rings 41 and 42 which are separated by a washer 44 of metal or some other rigid material.

When the shower head is in operation water will be provided from a suitable source through the shower pipe 11 and into head 14. With the cock 20 open the water will flow through passage 15 and port 22 into the chamber 45 which is defined by the ball 16, disk 35 and the O-ring seals 41 and 42. The combined open or flow-through area of the apertures 40 is somewhat less than that of the portion 26 of the passage 15 which causes the fluid pressure to build within chamber 45. This pressure build-up tends to force the washer 41 into a wedging position between ring 30 and ball 16 and the washer 42 into a similar functional position between ring 30 and disk 35 so as to seal chamber 45 except for discharge through apertures 40.

The interior configuration of the skirt 17 and the relationship of the walls thereof to the direction of outlet of apertures 40 are an important factor in the present invention and will now be described. As will be understood the water sprays S discharging from chamber 45 and through apertures 40 will be of relatively high velocity due to the pressure build-up in chamber 45. Due to the slanted condition of the disk portion 39 the sprays S will be directed downwardly in a diverging manner as shown in the drawing.

It is desirable that the jet sprays S be diffused or softened somewhat as they leave the shower head. This is best accomplished by directing the sprays against the lower inner edge of skirt 17. This edge is rounded as at 47 as best seen in FIG. 4. The skirt 17 is also provided with an interior wall 48 of frusto-conical shape and which wall is at such an angle as to deflect the sprays S as they are discharged from the jet apertures 40 into engagement with the lower portion of the skirt 17 at or just above the rounded edge 47. In other words, the angle between the axis of any aperture 40 and wall 48, denoted at *a* in FIG. 5, and the angle between wall 48 and a line from the contact point on the wall and edge 47, denoted at *g* in FIG. 5, are substantially equal. This causes each jet spray S to take an irregular path, denoted in FIGS. 1 and 5, as it is discharged from the shower head. Each spray is broken up twice, first as it contacts wall 48 and again as it passes over the edge 47. The sprays diverge in a generally conventional spray pattern from the shower head but jet force thereof is softened by the deflections just described.

The shower head accordingly economically and effectively carries out the aforementioned objectives.

Having now fully illustrated and described my invention, what I claim to be new and desire to protect by United States Letters Patent is:

1. In a shower head having an elongated body with one end adapted to be threaded onto the end of a water supply pipe and having a passage extending longitudinally therethrough, an annular skirt mounted on the other end of the body and positioned coaxially with said passage and extending axially a distance substantially beyond said other end of the body, a perforate plate member disposed between said other end of the body and the extended end of the skirt to restrict the flow of water from such passage through said skirt, said plate member having an annular series of apertures disposed about the axis of the skirt to divide the flow of water into a plurality of diverging jet sprays, the apertures and skirt being so formed as to direct said sprays into engagement with the edge portion of the extended edge of the skirt, and the entire inner side of the extended edge of said skirt having a smooth continuous surface.

2. The subject matter of claim 1 wherein the plate member has a dished shape with an annular frusto-conical wall in which said apertures are formed.

3. The subject matter of claim 1 wherein the end portion of the passage in said other end of the body has a nonround cross sectional shape to provide a socket for receiving a key wrench of the same cross sectional shape to tighten the body onto the water supply pipe.

4. The subject matter of claim 3 wherein a sleeve is mounted in encircling relation on the portion of the body adjacent said one end to prohibit gripping of the body in that area to unthread the body from the supply pipe.

5. The subject matter of claim 1 wherein said extended edge portion of the skirt is rounded to cause the jet sprays to further diverge after engaging said edge.

6. The subject matter of claim 1 wherein the surface of said inner side of the extended edge of the skirt gradually diverges from the axis of the skirt in its outward extension whereby as the sprays engage and pass said edge of the skirt they will diverge into a cone pattern.

7. In a shower head for attachment to a water supply pipe, a. an elongated body member having one end adapted to be threaded onto the supply pipe, a ball joint at its other end and a passage extending longitudinally through the member, b. a tubular discharge skirt mounted for universal movement on the ball joint and extending therebeyond, c. a disk mounted in the skirt adjacent to the ball joint and having an annular series of apertures for dividing the flow of water through the passage into a series of jet sprays directed outwardly through the skirt, d. said skirt having a frusto-conical interior wall intermediate the disk and the extended end edge of the skirt and positioned to deflect said jet streams into engagement with said end edge of the skirt as they are discharged from the skirt, e. a seal between the ball joint and the disk comprising a pair of coaxially disposed O-rings respectively in pressure sealing engagement with the ball joint and the disk, and f. the total cross sectional area of the apertures being less than the cross sectional area of the passage whereby the water pressure between the disk and ball joint will bias the O-rings in a separating direction to increase the sealing engagement thereof.

8. The subject matter of claim 7 wherein said O-rings are separated by rigid metal washer.

* * * * *